US007516696B2

(12) United States Patent
Mershimer

(10) Patent No.: US 7,516,696 B2
(45) Date of Patent: Apr. 14, 2009

(54) MEZZOTINT ROCKER MACHINE

(76) Inventor: Frederick Mershimer, 308 6th St., Apt. #3, Brooklyn, NY (US) 11215

( * ) Notice: Subject to any disclaimer, the term of this patent is extended or adjusted under 35 U.S.C. 154(b) by 581 days.

(21) Appl. No.: 11/282,124

(22) Filed: Nov. 18, 2005

(65) Prior Publication Data

US 2007/0126268 A1 Jun. 7, 2007

(51) Int. Cl.
*B41F 1/07* (2006.01)
*B44B 5/00* (2006.01)

(52) U.S. Cl. ..... 101/3.1; 101/150; 101/401.1

(58) Field of Classification Search ..... 101/3.1, 101/23, 28, 150, 401.1, 453, 465; 72/211
See application file for complete search history.

(56) References Cited

U.S. PATENT DOCUMENTS

| | | | | |
|---|---|---|---|---|
| 3,264,106 | A * | 8/1966 | Alldis | 355/77 |
| 3,789,704 | A * | 2/1974 | Noestheden | 81/9.2 |
| 4,368,587 | A * | 1/1983 | Childs | 40/615 |
| 2005/0011244 | A1* | 1/2005 | Hampton | 72/211 |

FOREIGN PATENT DOCUMENTS

JP 60250953 * 12/1985

OTHER PUBLICATIONS

"The Mezzotint, History and Technique" by Carol Wax, 1990 Published by Harry N. Abrams, Inc., New York. pp. 179-190.

* cited by examiner

*Primary Examiner*—Judy Nguyen
*Assistant Examiner*—Marissa L Ferguson-Samreth
(74) *Attorney, Agent, or Firm*—White & Case LLP

(57) ABSTRACT

The rocker machine of the invention can be worked to produce uniformly engraved plates of any size and suitable for mezzotint engraving. The rocker machine includes a table, a rocker assembly and a guide assembly. The table can be rotatable or fixed, and is inclined at an angle to the horizontal. The rocker assembly includes one or more rockers, one or more lateral members and a cross arm. Each rocker has a curved lower edge along which protrude a plurality of teeth. The lateral members are adapted for reciprocal translation along a horizontal axis, and are moveable along an axis substantially perpendicular to the plane of the rocker. The lateral members are attached at the proximal end to the rocker or to the cross arm and at the distal end are moveable along lateral guides. The cross arm is reciprocally moveable in a horizontal direction substantially in the plane of the rocker (or substantially in a plane, parallel to the plane of the rocker) and is moveable along an axis substantially perpendicular to the plane of the rocker. This reciprocal motion is sufficient to permit each rocker to rock along its curved edge, causing the teeth to penetrate the surface of the plate along the direction of rocking along the axis substantially perpendicular to the plane of the rocker, thereby produce indentations and burrs in the plate.

20 Claims, 5 Drawing Sheets

MEZZOTINT ROCKER MACHINE

FIELD OF THE INVENTION

The invention relates to the field of machining and engraving and to the production of printing plates for representation of a range of tones for a variety of purposes including the production of artistic works.

BACKGROUND

Mezzotint, a printing process of the intaglio or engraving family, is one of the most physically demanding printmaking media: a plate (usually of copper or steel) is "rocked" with a curved, saw-toothed blade until its surface is entirely pitted and burred to hold ink. Typically, a plate is rocked in eight to sixteen directions to achieve an even ground. When fully rocked, a field of metal burrs is created, and when inked and printed, the plate produces a deep uniform black print. A scraper or burnisher is then used to cut away or flatten the raised parts controlling the amount of ink retained around the burrs.

Mezzotint is a reductive process in which the image is created by working from dark to light. The rocked plate initially produces a full black tone when printed. Successive scraping or burnishing progressively produces dark grays, then light grays, and ultimately, white when the surface is completely smooth and can hold no ink. Colors can be added by scraping, burnishing and scoring a separate plate for each color used.

A Dutch amateur printmaker, Ludwig von Siegen, is believed to have originated mezzotint around 1640. The process gained favor in England where it became widely used in the early 1700s for the reproduction of paintings, especially landscapes and portraits. Eventually, the mezzotint process was supplanted with the advent of photography and has seen much more limited use over the last century.

Classically, plates were roughened by rubbing the surface with fine metal filings. The modern process typically involves the use of a steel rocker having a serrated or toothed blade in a shallow curved shape and a wooden handle projecting up from the steel blade. Rockers are commercially available in a range of sizes. Typically, commercially available mezzotint rockers have two and a half inch or five inch blades anywhere from forty-five to a hundred and twenty teeth per inch along the serrated edge of the blade.

The teeth of the serrated blade, when progressively rocked steadily from side to side along the edge of the blade on an engravable surface, cut rows of holes that push up small ridges of metal called burrs. Repeating this rocking across the entire length and width of the plate and then at right angles, or at several other angles to the original direction, produces a plate that is uniformly roughened, or engraved across its surface. When fully rocked across the entire surface of a plate, a field of burrs is created, which when inked and printed results in a solid velvety, black print.

Preparation of a single high quality 2 ft×3 ft plate can take hundreds of hours of exacting and laborious hand rocking. This enormous time commitment by the plate preparer is due to the necessity of rocking in each of the multiple directions in order to achieve an optimum smooth, deep and even print tone. Motorized devices have been produced to alleviate this long and arduous prerequisite process. However, plates produced by the machines available to date lack the rich velvety tones of hand worked plates. Specifically, the rich tones of hand-worked plates is likely due to the play of the rocker from side to side as well as along the direction of the blade. Hand rocking produces slightly variable indentations and the side to side play tends to throw up larger burrs than simple back and forth rocking. By contrast, the available motorized rockers generally produce uniform indentations and smaller burrs due to the more rigid repetitive motion with pressure bearing directly down on the metal. See, for example, the descriptions in "The Mezzotint, History and Technique" by Carol Wax, 1990, Harry N. Abrams, Inc., New York. pp. 179-190.

Other motorized devices have been limited in the size of the plates that can be accommodated, and in the available angles at which they can be rocked.

The engraved plates are then worked by artists to produce mezzotint prints. Where lighter areas are desired, the artist progressively cuts away or smoothes the raised portions and, or shaves the surface to remove indentations. These smoothed and/or shaved surfaces provides less and less accommodation for the ink that is ultimately transferred to the print and thus produces lighter and lighter tones in these areas of the work.

Mezzotints are prized for their range and richness, and also for their smoothness of tone, but preparation of the uniformly roughened plates is arduous when rocked by hand and generally gives less satisfactory results when produced mechanically without human intervention as the richness of tone is lost as a result.

SUMMARY OF THE INVENTION

The present invention provides a rocker machine that can be worked to produce uniformly engraved plates suitable for mezzotint engraving. Advantageously, the machines of the invention can be adapted to produce plates of any size that can be rocked in any direction from 0 to 360 degrees.

The invention provides a rocker machine that includes a table, a rocker assembly and a guide assembly. The table, which can be rotatable or fixed, is inclined at a first angle (A) to a horizontal plane and has a substantially flat surface for supporting a plate to be engraved.

The rocker assembly includes one or more rockers, one or more lateral members and a cross arm. Each rocker has a curved lower edge along which protrude a plurality of teeth for engraving the plate. Each rocker includes a rocker arm pivoted from the cross arm such that the rocker is capable of rocking along the curved edge and the point of contact between the plate and the teeth moves along the curved edge of the rocker.

The lateral members each have a proximal end and a distal end, and are adapted for reciprocal translation, i.e. back and forth movement, along a horizontal axis, and are moveable along an axis substantially perpendicular to the plane of the rocker. The lateral members are attached at the proximal end to the rocker or to the cross arm and at the distal end are moveable along lateral guides The guide assembly includes a means for guiding the lateral members along an axis substantially perpendicular to the plane of the rocker, the axis being disposed at a second angle (B) to a horizontal plane. The cross arm is reciprocally moveable in a horizontal direction substantially in the plane of the rocker (or substantially in a plane, P, parallel to the plane of the rocker) and is moveable along an axis substantially perpendicular to the plane of the rocker. This reciprocal motion is sufficient to permit each rocker to rock along its curved edge, causing the teeth to penetrate the surface of the plate along the direction of rocking along the axis substantially perpendicular to the plane of the rocker, thereby produce indentations and burrs in the plate.

The present invention also provides a method for producing a mezzotint plate. The method includes: (a) providing a table inclined at an angle (A) to a horizontal plane and having a substantially flat surface for supporting a plate having an engravable surface; (b) rocking one or more rockers, each having a plurality of teeth arranged along a curved edge, wherein each rocker comprises a rocker arm pivoted from a cross arm, rocking along the curved edge of the rocker such that the point of contact between the plate and the teeth moves along the curved edge of the rocker. Each rocker arm is articulated to a lateral member, or to the cross arm. The cross arm reciprocates along a horizontal axis sufficient to rock each rocker along its curved surface, causing the teeth to penetrate the surface of the plate along the direction of rocking, i.e., along the direction substantially perpendicular to the plane of the rocker, and thereby producing indentations and burrs in the plate.

The process may be repeated one or more times after rotating the plate so that the rockers produce indentations and burrs in the plate in orientations different from that of the originally formed indentations and burrs.

The present invention further provides an engraved plate produced according to the above-described method. Plates produced according to this method are particularly suitable as substrates for high quality artwork.

DETAILED DESCRIPTION OF THE INVENTION

Figure 1:
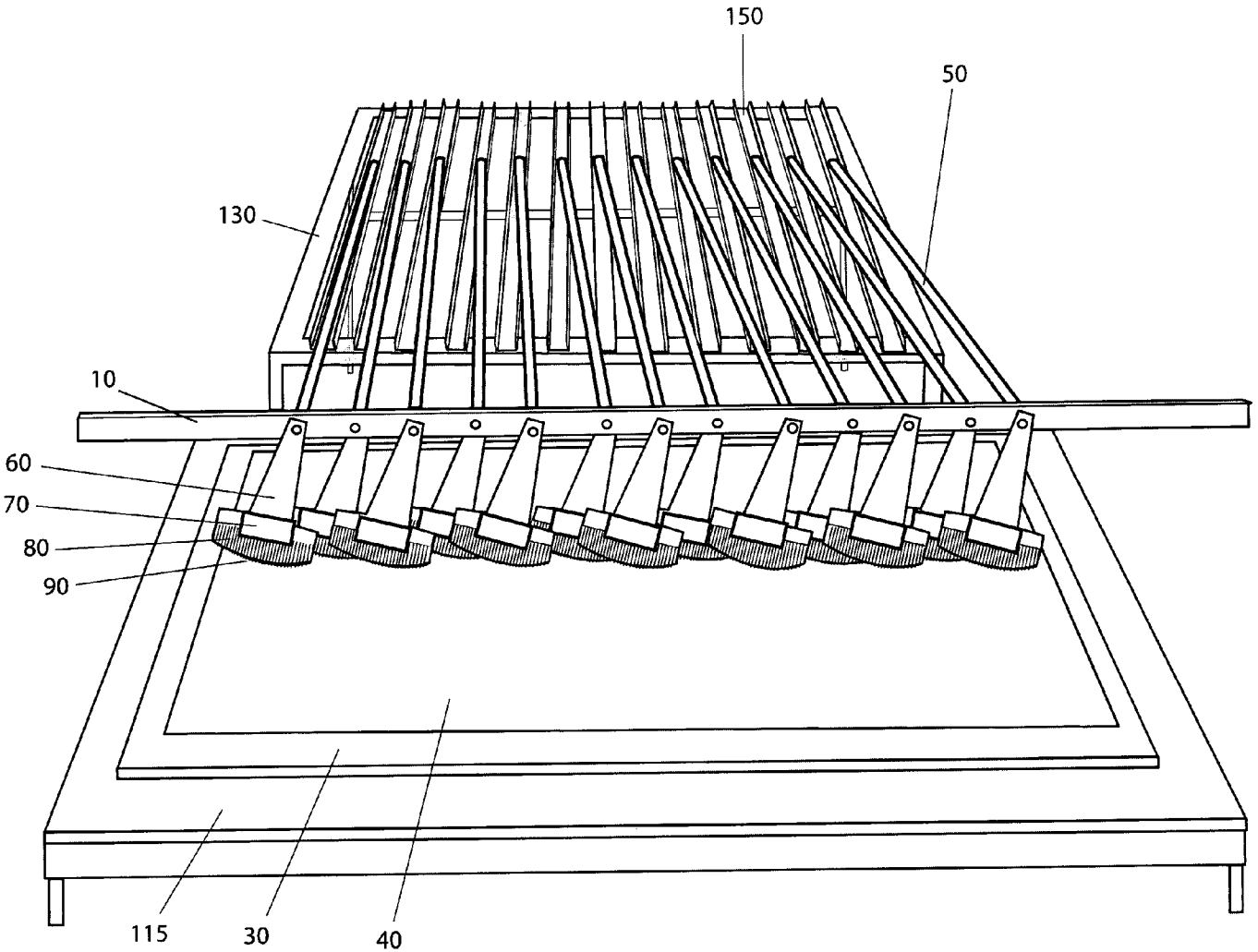
FIG. 1 is a perspective view of a rocker machine having multiple rockers, each comprising a rocker arm 60, a serrated blade 80 with a curved, toothed edge 90. The rocker may be weighted with a weight 70, as shown. The rocker arm 60 is articulated to a cross arm 10, to which are attached multiple lateral members 50. The lateral members freely slide in the lateral guides 150 supported on a frame 130. The engravable plate 40 is held in position by a suitably-sized table 30 supported on a fixed base 115.

The invention provides a rocker machine that includes a moveable or fixed table 30, a rocker assembly 120 and a guide assembly 130. (See FIGS. 1, 2 and 3). In an embodiment of the invention, the table comprises a mask edging for receiving the plate to be etched such that the edge of the plate 40 is level with the edge of the table 30 as shown in FIG. 1.

Figure 2:
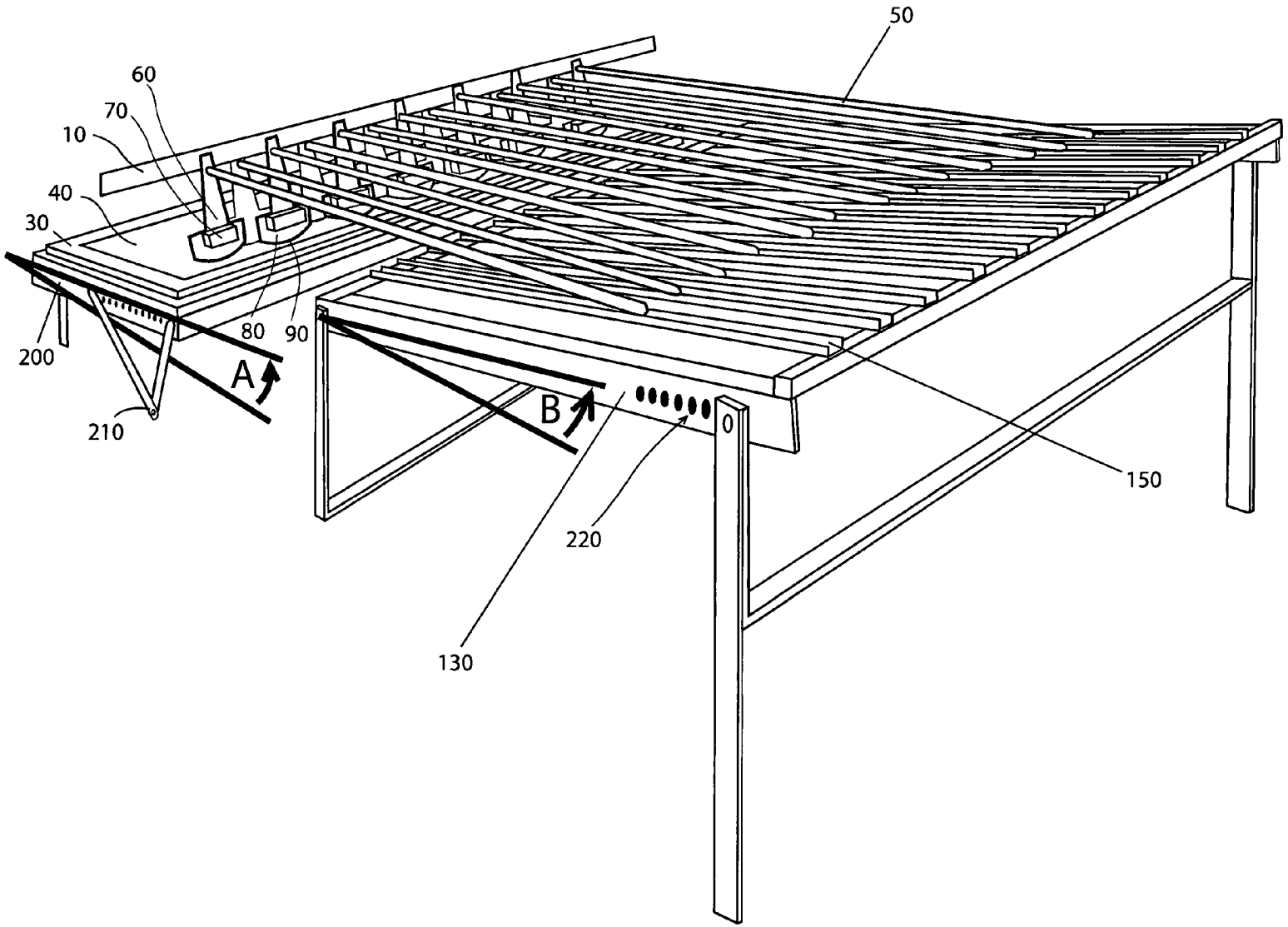
FIG. 2 is a perspective view of the rocker machine shown in FIG. 1 from the opposite direction. The angle of the table 30 to the horizontal can be adjusted by altering the angle of the supporting frame by securing the supports 210 at any of the optional anchor points. Similarly, the angle of the lateral guides to the horizontal can be adjusted by altering the angle of the supporting frame by securing the elongated vertical support at any of the optional anchor points 220.

The table 30 is disposed at an angle A to a horizontal plane; and the lateral guides 20 are disposed at an angle B to a horizontal plane. In one embodiment, the angles A and B are approximately equal. The table 30 has a substantially flat surface for supporting a plate 40 to be prepared as a printing plate. The table may be disposed so that the plate 40 is supported with its engravable surface inclined at an angle A to a horizontal plane as shown in FIG. 2.

The angle A can be any angle from zero to 20 degrees. When A is zero, the engravable surface of the plate 40 is horizontal. In one embodiment of the present invention, the angle A is from about zero to about 20 degrees. The angle A is from about zero to about 20 degrees. In another embodiment, A is about 15 degrees.

The table 30 can be fixed or moveable and may be supported on a substrate 200. In one embodiment, the table is rotatable. For example, the table 30 is rotatable about an axis perpendicular to the surface 35 of the table. The table 30 may be rotated by any suitable means as would be clear to those of ordinary skill, such as, for instance, rotating by hand or by machine about a pivot a the center of the table. Alternatively, if the table 30 is fixed, the plate to be engraved 40 may be rotated about an axis perpendicular to the surface of the plate.

The plate should have an engravable surface. Any surface that yields to engraving, scraping and scoring can be used. Metal plates are most commonly employed. The metal may be any metal that yields to engraving by a hard-toothed rocker. The metal may be a pure metal or a metal alloy. Examples of suitable metals and alloys include, without limitation, copper, steel and brass. Copper is particularly suitable due to its excellent malleability and ductility. However, steel plates have also been used, especially for applications where the plates are required to produce many more prints than are possible with copper plates due to wear of the roughened surface by repeated printing. Plates of hard metal such as steel are more difficult to engrave due to the increased pressure necessary to score the plates and also because they are prone to fragmentation of the burrs due to their inherent brittleness.

The rocker assembly 120 comprises a plurality of rockers 80 and one or more lateral members 50. Each rocker includes a rocker blade attached to a rocker arm. Each lateral member is optionally articulated through the cross arm, or directly to the rocker arm. Each of the rockers has a plurality of teeth 90 arranged along its curved edge in a plane P, and includes a rocker arm 60 pivoted from a cross arm 10.

Figure 3:
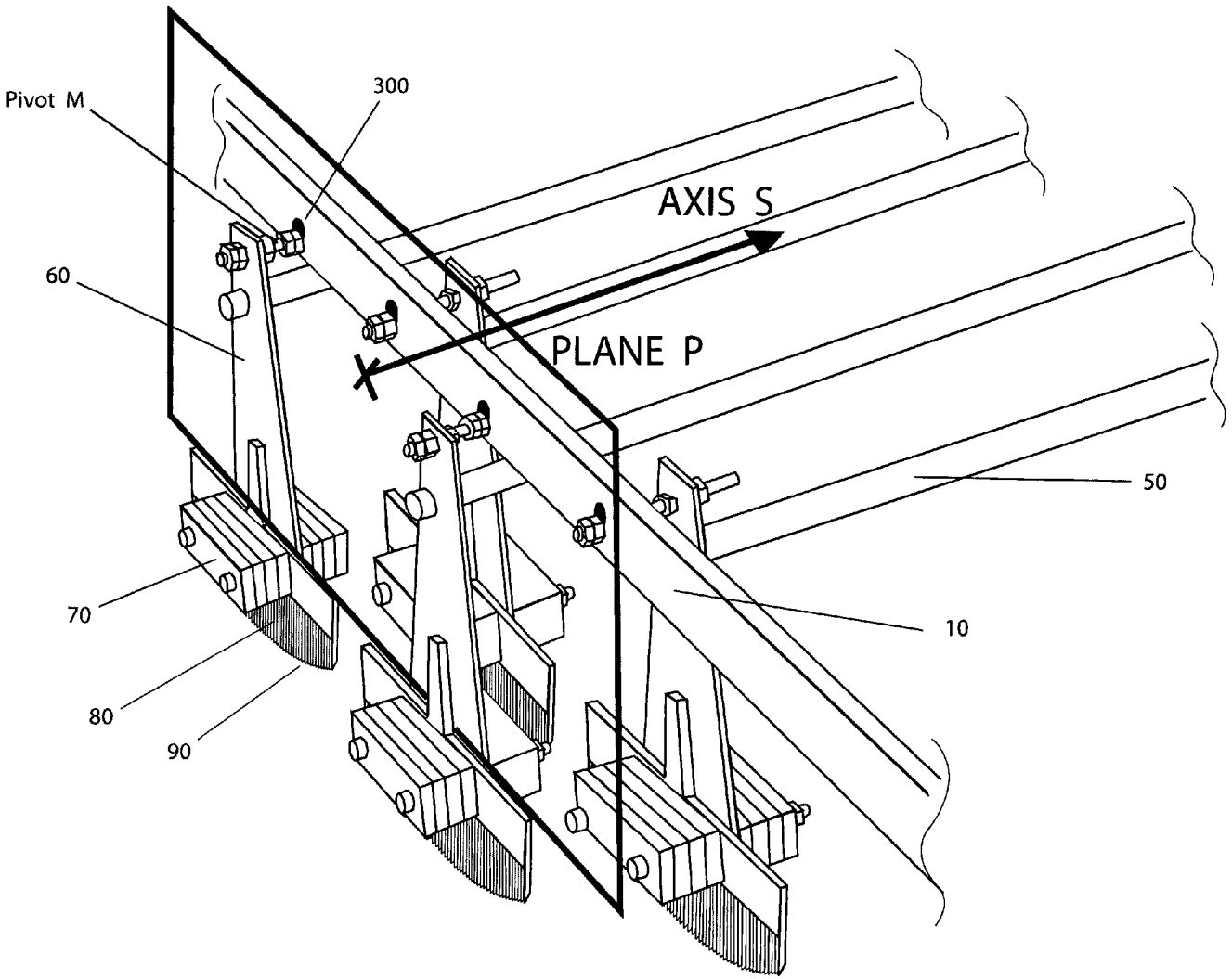
FIG. 3 is an expanded partial view showing details of the articulation of the rocker arms through a pivot that is free to slide in a slot 300 to the cross arm 10 and the attachment of the lateral members 50.

The curved edge of the rockers can be any curvilinear shape that permits contact of each segment of the edge of the rocker with the plate to be engraved. For example, the curved edge of each rocker substantially conforms to a shallow convex curve. It has been generally found that a particularly advantageous shape of the curved edge of the rockers substantially conforms to an arc of a circle, or an segment of a parabola. Suitable rockers for use in the present invention are commercially available, for instance, from Blick Art Materials, Wheaton and Galesburg, Ill. The curved lower edges of the rockers 90 are disposed in a plane P, and/or are in one or more planes parallel to plane P See FIG. 3. The lateral members 50 are capable of reciprocal translation along a horizontal axis and moveable along an axis, S substantially perpendicular to plane P swept by the rocker and rocker arm as shown in FIG. 3. The lateral members 50 are directly or indirectly articulated to the rockers. The articulation of the lateral members 50 to the rockers can be by direct attachment at their proximal ends 160 to the rockers 80, or indirectly by attachment to the cross arm 10.

The articulation of the rockers to the lateral members limits the travel of the rockers. During the rocking process, each rocker progresses substantially in plane P. As the rocker rocks towards the limit of the curved edge 90, the plane of the rocker is forced to traverse along a curve having a radius approximating the length of the lateral member to which it is articulated.

In one embodiment of the mezzotint rocking machine, the angle B is sufficient to cause the lateral members 50 to be moved down the lateral guides by gravity along an axis substantially perpendicular to the plane P as the rockers reciprocate from side to side. Thus, the tracks of the rockers form a zig-zag path along the plate in the direction substantially perpendicular to the plane P.

Cross arm 10 can be any structure that articulates the motion of the rockers with the lateral member or lateral members. In one particular embodiment, a cross arm 10 comprises pivots M to which rocker arms are articulated. Multiple rockers provide coordination of the rocker paths and concomitant engraved tracks. Any number of rockers can be articulated to the cross arm. Preferably between about five and fifty, more preferably between about ten and thirty, and optimally between about fifteen and twenty rockers are articulated to the cross arm 10. In another embodiment, the rockers may be articulated to more than one cross arm, articulated such that the movement of the cross arms is coordinated.

One or more lateral members may be affixed to a single rocker arm for maintaining the rockers in an upright orientation.

The distance between the furthest extent of travel of the rockers at the limits of the reciprocal translation is the distance of travel of the rockers, limited by the maximum length of the plate, and the distance between the proximal and the distal ends of the lateral members 50 is at least as long as the distance of travel of the rockers on the surface of the plate.

In another embodiment of the present invention, each rocker arm 60 of the rocker machine has a proximal end articulated to a lateral member and a distal end capable of moving along the axis of the lateral guide at an angle B to the horizontal. The rocker arm is articulated to the lateral member by means of a pivot M, [The pivot M is slideably suspended from an elongated slot 300, (see FIG. 3) along the axis of the rocker arm to permit the teeth to press on the surface of the plate 40 under its own weight. This compensates for any variances in rocker blades 80, and providing even pressure from each of the rockers. The rocker may be formed from a material that has substantial weight. Alternatively, additional weight may be attached to the rocker (70 in FIG. 3) or to the rocker arm.

The guide assembly 130 includes a means for guiding the lateral members 50 approximately along axis S, perpendicular to plane P and disposed at an angle B to a horizontal plane. The means for guiding the lateral members may be any guide means, such as for instance, a trough 150, a slot or a rail, wherein the lateral member is articulated to the slot or rail via a hook, a slide, a wheel or any other articulation means.

The cross arm 10 is reciprocally moveable in a horizontal direction substantially in plane P, or parallel thereto, sufficient to permit each rocker 80 to reciprocate in a rocking motion along its curved edge causing the teeth 90 to penetrate the surface of the plate 40 along the direction of rocking and proceeding along the axis S perpendicular to the plane P in a shallow zigzag fashion and thereby produce indentations and burrs progressively along the plate.

The present invention further provides a method for producing a mezzotint plate including the steps of: (a) providing a table 30 having a substantially flat surface for supporting a plate 40 having an engravable surface 45, wherein the table is disposed at a angle A to a horizontal plane; (b) rocking a plurality of rockers 80 each having a plurality of teeth arranged along a curved edge 90, wherein each rocker 80 comprises a rocker arm 60 pivoted from a cross arm 10 rocking along the curved edge of the rocker 90 and moving along an axis S substantially perpendicular in a plane P; wherein the cross arm 10 reciprocates along a horizontal axis sufficient to rock each rocker 80 along its curved surface 90, causing the teeth to penetrate the surface of the plate 45 along the direction of rocking and along an axis substantially perpendicular to a plane P thereby produce indentations and burrs in the engravable plate 40.

A zig-zag motion of the rocker across the plate leads to the rocker advancing across the plate surface. The shallower the zig-zag, the more closely spaced the lines of burring and engraving, yielding a more even and finely covered mezzotint plate.

Figure 4:
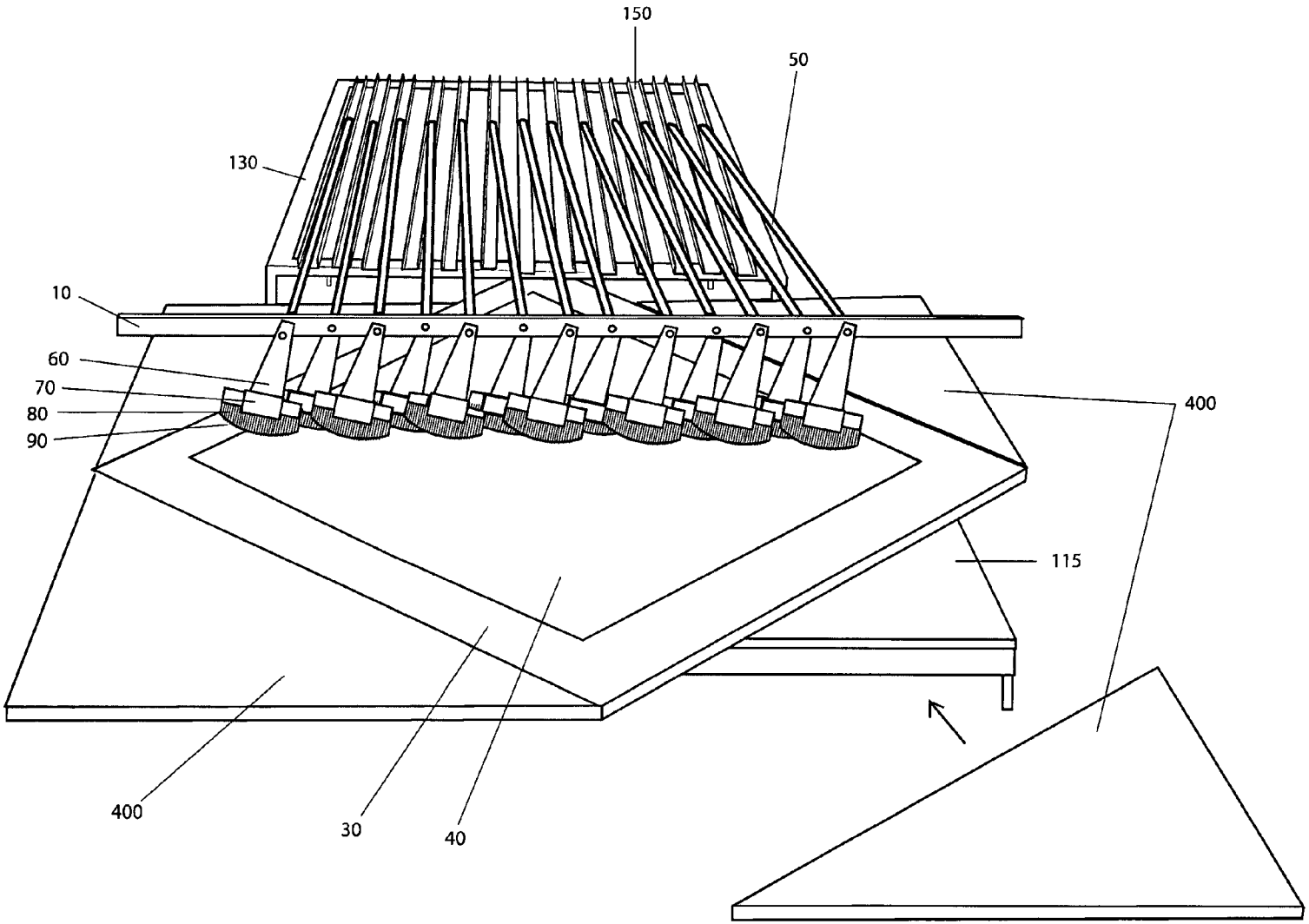
FIG. 4 shows the same perspective view as in FIG. 1, with the table 30 rotated 45° about its center. Triangular compensating pieces 400 abut the table 30, or the plate 40 providing an even surface across and beyond the edges of the plate permitting the rockers to traverse the full dimension of the plate in any direction without encountering a step at the edge of the plate.
Figure 5:
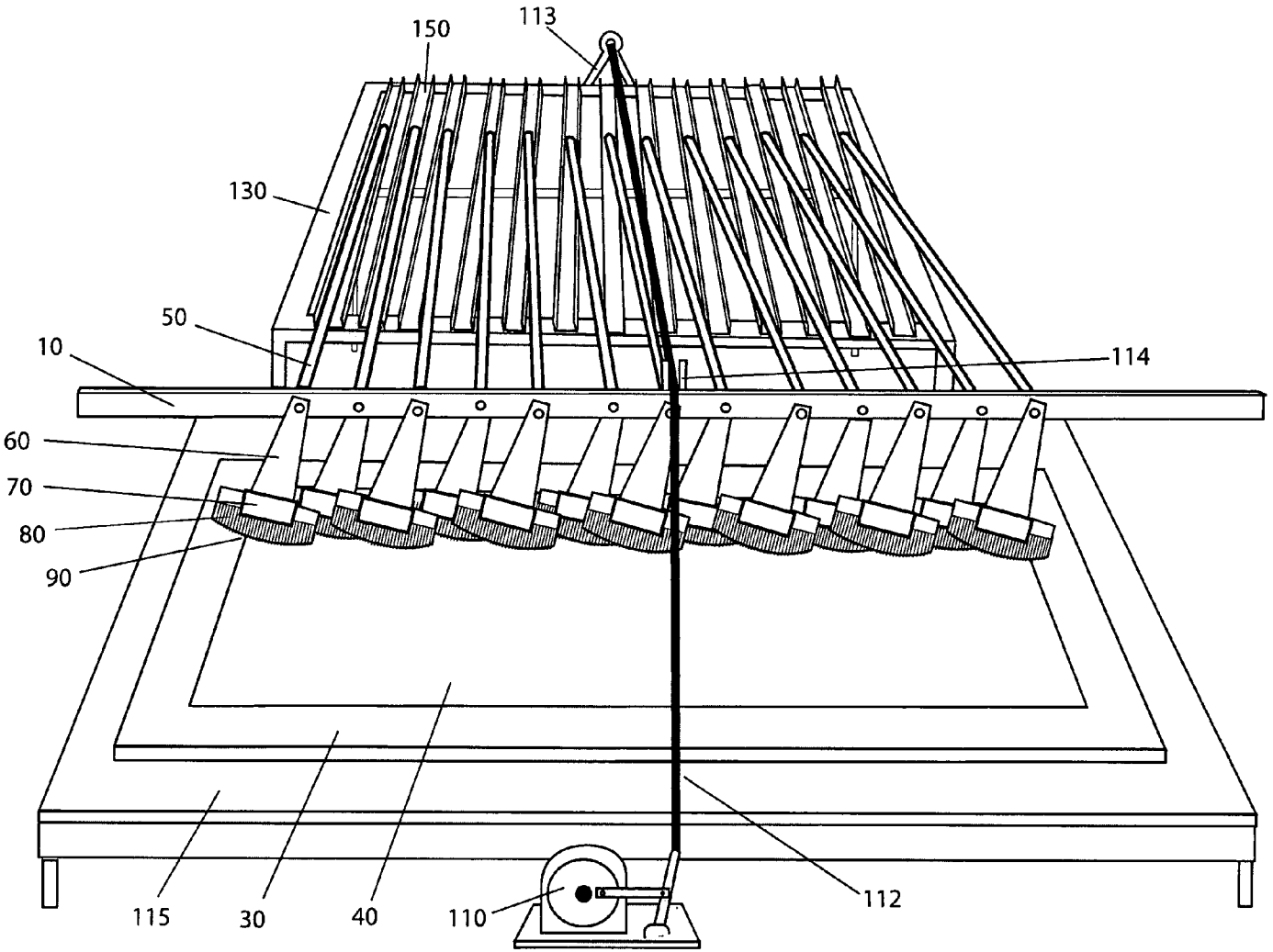
FIG. 5 shows an adaptation of the rocker machine of FIG. 1 including a motor 110 driving the reciprocating motion of a motivator bar 112 restrained by stays 114 attached to the cross arm and fastened at the other end by an anchor 113 set in the guide assembly.

After indentations and burrs in a pattern on the plate 40 are produced in a first orientation, the plate can be rotated in a second orientation and the method repeated to produce new indentations and burrs across the surface in a zig-zag pattern at an angle to the first pattern of indentations and burrs. In order to prevent edge effects and to provide an even surface for travel of the rockers, end plates 400 may be aligned along the angled edge of the table 30 as shown in FIG. 4.

The rockers are moved reciprocally at a suitable speed sufficient to move the rockers along the plate 40 along the direction of the cross arm 10, and cause indentations and burrs, but not sufficient to cause scoring, i.e. cutting channels across the plate. The speed of the rockers determines the quality of the burr: too slow and the rockers do not travel down the plate and continually cut in the same place; too fast and the lateral motion is too strong, causing scoring. The articulation allows for the rocker teeth 90, to take advantage of the lateral momentum of the rocker 80, as it sways back and forth and moves down the plate 40. The lateral momentum of the cross arm 10, and the articulating rockers 80, not only provides for the cuts into the plate, but also pushes the rocker slightly side to side, creating the desired burrs. Determination of a suitable reciprocation speed of the rockers is within the expertise of the person of ordinary skill in the art taking into account the material of the plate and the desired depth and density of pitting and burring in the plate.

In one embodiment, the cross arm 10 is moved by non-mechanical means, such as by a human. However, the motion of the cross arm may be mechanically assisted.

The plate 40 can comprise copper, steel or other metal, or alloy such as a brass, or any other suitable engravable material.

The present invention further provides engraved mezzotint plates produced by any of the above-described methods. An engraved mezzotint plate produced by the methods of the present invention exhibit substantially uniform indentations and burrs across the plate. The indentations and burrs are orientated in more than one direction. Those of skill will immediately recognize the full scope of the present invention. The above examples are intended to be illustrative and should not be taken to represent limitations to the scope of the invention.

I claim:

1. A rocker machine comprising:

(a) a table having a substantially flat surface for supporting a plate having an engravable surface, wherein the table is disposed at an angle A to a horizontal plane;

(b) a rocker assembly comprising a plurality of rockers, one or more lateral members and a cross arm, wherein each rocker has a plurality of teeth arranged along a curved edge and comprises a rocker arm pivoted from the cross arm, and wherein each rocker is capable of rocking along the curved edge substantially in a plane P and is movable along an axis substantially perpendicular to the plane P, and wherein each lateral member has a proximal and a distal end and is attached at the proximal end to the rocker arm or to the cross arm, and wherein each lateral member is adapted for reciprocal translation along a horizontal axis and moveable along an axis substantially perpendicular to plane P; and (c) a guide assembly comprising a means for guiding each lateral member along an axis S substantially perpendicular to the plane P and disposed at an angle B to a horizontal plane;

wherein the cross arm is reciprocally moveable in a horizontal direction substantially in the plane P or parallel thereto sufficient to permit each rocker to rock along its curved edge causing the teeth to penetrate the surface of the plate along the direction of rocking and along the axis S substantially perpendicular to the plane P thereby producing indentations and burrs in the plate.

2. The rocker machine according to claim 1, wherein the curved edge of each rocker substantially conforms to an arc of a circle or a segment of a parabola.

3. The rocker machine according to claim 1, further comprising a means for rotating the table about an axis perpendicular to the surface of the table.

4. The rocker machine according to claim 1, wherein the table is rotatable about an axis substantially perpendicular to the surface of the table.

5. The rocker machine according to claim 1, wherein the angles A and B are approximately equal.

6. The rocker machine according to claim 1, wherein curved edges of the plurality of rockers are disposed in plane P.

7. The rocker machine according to claim 6, wherein curved edge of the plurality of rockers are in plane P.

8. The rocker machine according to claim 1, wherein curved edges of the plurality of rockers are disposed in plane P and one or more planes parallel to plane P.

9. The rocker machine according to claim 1, wherein each rocker arm has a proximal end and a distal end and is suspended from a pivot M, and wherein the pivot is slideably suspended from a slot elongated along the axis of the rocker arm to permit the teeth to press on the surface of the plate. Pivot comprises an elongated slot which allows the vertical travel of the rocker along an axis perpendicular to the plate.

10. A method for producing a mezzotint plate comprising:

(a) providing a table having a substantially flat surface for supporting a plate having an engravable surface, wherein the table is disposed at a angle A to a horizontal plane;

(b) rocking a plurality of rockers each having a plurality of teeth arranged along a curved edge, wherein each rocker comprises a rocker arm pivoted from a cross arm, and is capable of rocking along the curved edge of the rocker in a plane P;

the cross arm reciprocating along a horizontal axis sufficient to rock each rocker along its curved surface causing the teeth to penetrate the surface of the plate along the direction of rocking and along an axis S substantially perpendicular to the plane P thereby produce indentations and burrs in the plate.

11. The method according to claim 10, wherein the distal ends of the lateral members are moved by gravity.

12. The method according to claim 10, wherein the cross arm is moved by a human operator.

13. The method according to claim 10, wherein the cross arm is moved mechanically.

14. The method according to claim 10, wherein the indentations and burrs in the plate are produced in a first orientation of the plate and after the plate is rotated in a second orientation.

15. The method according to claim 10, wherein the rockers are moved reciprocally at a speed sufficient to move the rockers along the plate along the direction of the cross arm.

16. The method according to claim 10, wherein the plate comprises copper.

17. An engraved plate produced according to the method of claim 10.

18. The engraved plate according to claim 17, comprising copper.

19. The engraved plate according to claim 17, wherein the indentations and burrs in the plate are oriented in more than one direction.

20. The engraved plate according to claim 19, wherein the indentations and burrs in the plate are substantially uniform across the plate.

* * * * *